US012540429B2

(12) United States Patent
Sato et al.

(10) Patent No.: US 12,540,429 B2
(45) Date of Patent: Feb. 3, 2026

(54) SEWING MACHINE

(71) Applicant: JUKI CORPORATION, Tokyo (JP)

(72) Inventors: Kuniaki Sato, Tokyo (JP); Tatsuya Ogawa, Tokyo (JP); Yukiyo Nomoto, Tokyo (JP); Hajime Nakayama, Tokyo (JP); Takahiro Higa, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 0 days.

(21) Appl. No.: 18/522,103

(22) Filed: Nov. 28, 2023

(65) Prior Publication Data

US 2024/0175184 A1 May 30, 2024

(30) Foreign Application Priority Data

Nov. 29, 2022 (JP) ..... 2022-190732

(51) Int. Cl.

| | |
|---|---|
| ***D05B 55/06*** | (2006.01) |
| ***D05B 1/08*** | (2006.01) |
| ***D05B 27/10*** | (2006.01) |
| ***D05B 29/00*** | (2006.01) |

(Continued)

(52) U.S. Cl.

CPC ..... *D05B 55/06* (2013.01); *D05B 1/08* (2013.01); *D05B 27/10* (2013.01); *D05B 29/00* (2013.01); *D05B 57/10* (2013.01); *D05B 69/12* (2013.01)

(58) Field of Classification Search

CPC ..... D05B 29/00; D05B 55/06; D05B 27/10; D05B 55/14

See application file for complete search history.

(56) References Cited

U.S. PATENT DOCUMENTS 4,122,787 A * 10/1978 Conti ..... D05B 1/04 112/475.17
4,274,345 A * 6/1981 Schneider ..... D05B 35/08 112/311

(Continued)

FOREIGN PATENT DOCUMENTS

CN 115323631 A * 11/2022
DE 9012496 U1 10/1990

(Continued)

OTHER PUBLICATIONS

Extended European Search Report from European Patent Application No. 23212585.6, dated Mar. 27, 2024, 7 pages.

*Primary Examiner* — Tajash D Patel
(74) *Attorney, Agent, or Firm* — BAKERHOSTETLER

(57) ABSTRACT

A sewing machine that suppresses sewing defects is provided. The sewing machine includes: a sewing needle, held by a needle bar and moving back and forth while holding an upper thread; a shuttle, configured to hold a bobbin around which a lower thread is wound and which is housed in a bobbin case, and cooperating with the sewing needle to form a seam; a presser foot member, configured to press a to-be-sewn article at a sewing position directly below the sewing needle; a feeding mechanism, feeding the to-be-sewn article from the sewing position to a first direction; a needle drive portion, provided separately from a belt drive portion to synchronously move the sewing needle and the presser foot component in the first direction; and a control portion, which controls so that the needle drive portion and the belt drive portion operate independently.

4 Claims, 5 Drawing Sheets

(51) Int. Cl.
*D05B 57/10* (2006.01)
*D05B 69/12* (2006.01)

(56) References Cited

U.S. PATENT DOCUMENTS

| | | | | | |
|---|---|---|---|---|---|
| 4,706,587 | A * | 11/1987 | Shiomi | ..... | D05B 29/02<br>112/237 |
| 4,876,975 | A | 10/1989 | Braun | | |
| 7,891,307 | B2 * | 2/2011 | Sakuma | ..... | D05B 93/00<br>112/475.17 |
| 8,661,997 | B2 * | 3/2014 | Sakuma | ..... | D05B 1/16<br>112/475.17 |
| 9,150,991 | B1 * | 10/2015 | Kalkbrenner | ..... | D05B 21/00 |
| 9,617,673 | B1 * | 4/2017 | Martelli | ..... | D05B 57/26 |

FOREIGN PATENT DOCUMENTS

| | | | | | |
|---|---|---|---|---|---|
| DE | 102004019001 | A1 | 12/2004 | | |
| EP | 2138619 | | 12/2009 | | |
| WO | WO-2022206002 | A1 * | 10/2022 | ..... | D05B 27/02 |

* cited by examiner

SEWING MACHINE

FIELD

The present disclosure relates to a sewing machine.

BACKGROUND

In a field of sewing machines, a sewing machine, called a straight-stitch sewing machine, is known as disclosed in Japanese Patent Application Publication No. 2019-212194.

SUMMARY

Problem to be Solved

In the above-mentioned sewing machine, a throat plate having a needle hole is provided directly below a sewing needle, and the sewing needle moves back and forth while holding a to-be-sewn article between the throat plate and a presser foot member. In this structure, when the sewing needle moves back and forth, resistance is exerted on a thread between the needle hole and the to-be-sewn article, which may cause sewing defects.

The present disclosure is made in view of the above circumstance, and aims to provide a sewing machine capable of suppressing sewing defects.

Beneficial Effects

The present disclosure provides a sewing machine, including: a sewing needle, where the sewing needle is held by a needle bar, and the sewing needle moves back and forth while holding an upper thread; a shuttle, where the shuttle is configured to hold a bobbin around which a lower thread is wound and which is housed in a bobbin case, and the shuttle cooperates with the sewing needle to form a seam: a presser foot member, configured to press the to-be-sewn article at a sewing position directly below the sewing needle: a feeding mechanism, feeding the to-be-sewn article from the sewing position to a first direction: and a needle hole guide mechanism, where the needle hole guide mechanism includes: a needle hole guide member, provided directly below the sewing needle, supporting a lower surface of the to-be-sewn article, and including a needle hole through which the sewing needle passes in a vertical direction, and movable in the vertical direction; and a guide drive portion, driving the needle hole guide member to move independently in the vertical direction: and a control portion, configured to control the guide drive portion to make the needle hole guide member move up and down independently of a reciprocating movement of the sewing needle.

Beneficial Effects

According to the present disclosure, sewing defects can be suppressed.

REFERENCE NUMERALS

LT: lower thread; P1: raised position; P2: lowered position; PS: sewing position; S: to-be-sewn article; Sb: back surface; SE: seam; UT: upper thread; 1: sewing machine; 2: sewing machine head; 3: sewing needle; 4: needle bar; 5: thread take-up lever; 6: thread adjuster; 7: throat plate; 7*b* and 25*b*: upper surface; 8: presser foot member; 9: shuttle; 10, 23A, 23B and 27: motor; 11: feeding mechanism; 12: needle hole guide mechanism; 13 and 30: control portion; 21, 21A and 22B: feeding belt; 21A and 22B: belt; 22: belt drive portion; 22A and 22B: drive line; 24A and 24B: pulley; 25: needle hole guide member; 25*a*: needle hole; 26: guide drive portion; 28: transmission mechanism; 31: processing portion; 32: storage portion; 33: lifting drive control portion; 34: belt drive control portion; 35: determination portion; 36: guide drive control portion.

DETAILED DESCRIPTION

Hereinafter, embodiments according to the present disclosure will be described based on the drawings. In addition, the present disclosure is not limited to the embodiments. The structural elements of the following embodiments include modes that can be relocated and easily implemented by those skilled in the art, or modes that are substantially the same.

A sewing machine 1 according to this embodiment will be described. In this embodiment, positional relationships of each part is explained based on a local coordinate system defined in the sewing machine 1. The local coordinate system is defined using a XYZ orthogonal coordinate system. A direction parallel to an X-axis in a predetermined plane is set as an X-axis direction (second direction). A direction parallel to a Y-axis in the predetermined plane orthogonal to the X-axis is set as a Y-axis direction (first direction). A direction parallel to a Z-axis orthogonal to the predetermined plane is set as a Z-axis direction. A rotation direction centered on the X-axis is set as a θX direction.

Figure 1:
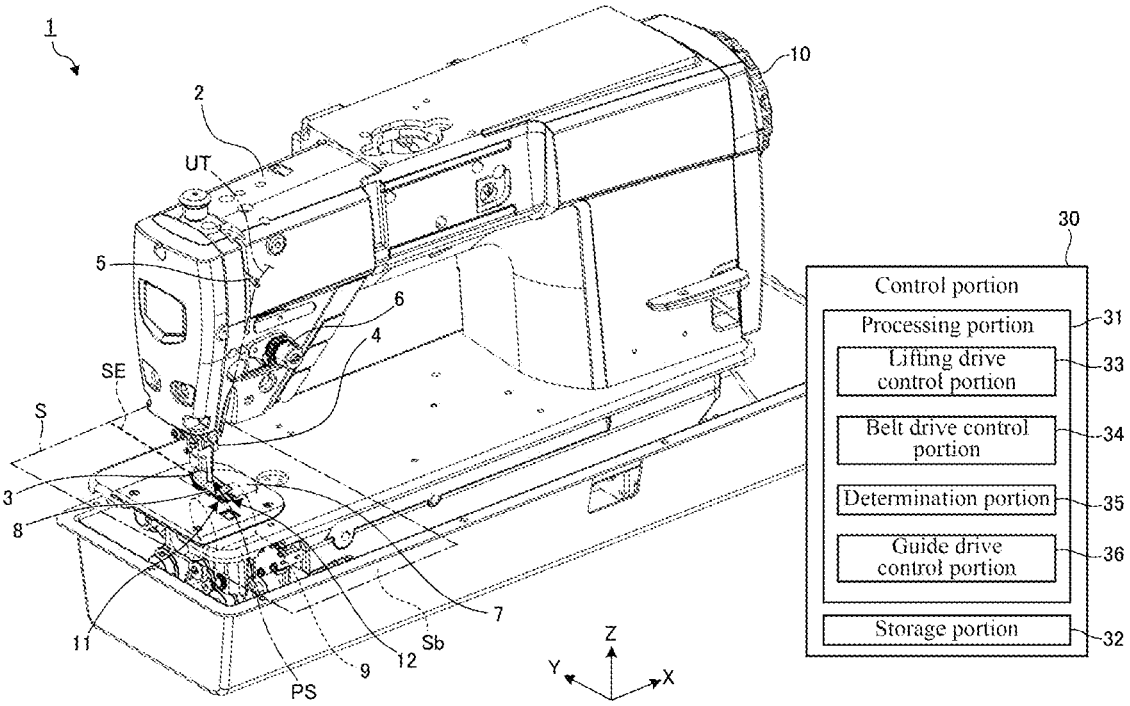
FIG. 1 is a perspective view schematically showing a sewing machine according to an embodiment.

FIG. 1 is a perspective view schematically showing a sewing machine according to an embodiment. As shown in FIG. 1, the sewing machine 1 includes: a sewing machine head 2, a needle bar 4, a thread take-up lever 5, a thread adjuster 6, a throat plate 7, a presser foot member 8, a shuttle 9, a motor 10, a feeding mechanism 11, a needle hole guide mechanism 12 and a control portion 30.

The needle bar 4 holds a sewing needle 3 to move back and forth in the Z-axis direction. The needle bar 4 holds the sewing needle 3 in a manner that the sewing needle 3 is parallel to the Z-axis. The needle bar 4 is supported by the sewing machine head 2. The needle bar 4 is provided above the throat plate 7 and can face a surface of a to-be-sewn article S. An upper thread UT is hung on the sewing needle 3. The sewing needle 3 includes a threading hole through which the upper thread UT passes. The sewing needle 3 keeps the upper thread UT on an inner surface of the threading hole. Since the needle bar 4 moves back and forth in the Z-axis direction, the sewing needle 3 moves back and forth in the Z-axis direction while holding the upper thread UT.

The thread take-up lever 5 supplies the upper thread UT to the sewing needle 3. The thread take-up lever 5 is supported by the sewing machine head 2. The thread take-up lever 5 includes a thread take-up lever hole through which the upper thread UT passes. The thread take-up lever 5 holds the upper thread UT on an inner surface of the thread take-up lever hole. The thread take-up lever 5 moves back and forth in the Z-axis direction while holding the upper thread UT. The thread take-up lever 5 moves back and forth in conjunction with the needle bar 4. The thread take-up lever 5 feeds out the upper thread UT or pulls up the upper thread UT by moving back and forth in the Z-axis direction.

The thread adjuster 6 (upper thread tension adjustment structure) applies tension to the upper thread UT. The upper thread UT is supplied to the thread adjuster 6 from a thread supply source. In a path through which the upper thread UT passes, the thread take-up lever 5 is provided between the sewing needle 3 and the thread adjuster 6. The thread adjuster 6 adjusts the tension of the upper thread UT supplied to the sewing needle 3 through the thread take-up lever 5.

The throat plate 7 supports the to-be-sewn article S. The sewing needle 3 held by the needle bar 4 faces the throat plate 7. The throat plate 7 is provided around the needle hole guide mechanism 12 described below.

The presser foot member 8 presses the to-be-sewn article S from above. The presser foot member 8 is supported by the sewing machine head 2. The presser foot member 8 is provided above the throat plate 7, and the to-be-sewn article S is held between the presser foot member 8 and the throat plate 7.

The shuttle 9 holds a bobbin housed in a bobbin case. The shuttle 9 is provided below the throat plate 7. The shuttle 9 rotates in a 0X direction. The shuttle 9 rotates in conjunction with the needle bar 4. The shuttle 9 supplies a lower thread LT. The shuttle 9 penetrates the to-be-sewn article S supported by the throat plate 7 and pulls up the upper thread UT from the sewing needle 3 that passes through a needle hole of the throat plate 7.

The motor 10 generates power. The motor includes: a stator supported by the sewing machine head 2 and a rotor rotatably supported by the stator. The motor 10 generates power by rotating the rotor. The power generated by the motor 10 is transmitted to the needle bar 4, the thread take-up lever 5 and the shuttle 9 respectively through a power transmission mechanism (not shown). The needle bar 4, the thread take-up lever 5 and the shuttle 9 are linked together. By transmitting the power generated by the motor 10 to the needle bar 4, the needle bar 4 and the sewing needle 3 held by the needle bar 4 move back and forth in the Z-axis direction. By transmitting the power generated by the motor 10 to the thread take-up lever 5, the thread take-up lever 5 moves back and forth in the Z-axis direction in conjunction with the needle bar 4. By transmitting the power generated by the motor 10 to the shuttle 9, the shuttle 9 rotates in the θX direction in conjunction with the needle bar 4 and the thread take-up lever 5. The sewing machine 1 sews the to-be-sewn article S through cooperation of the sewing needle 3 held by the needle bar 4 and the shuttle 9.

The feeding mechanism 11 feeds the to-be-sewn article S from a sewing position PS to the Y-axis direction. In this embodiment, the feeding mechanism 11 is provided below the to-be-sewn article S provided at the sewing position PS. In addition, another feeding mechanism may also be provided above the article S provided at the sewing position PS. The feeding mechanism 11 includes a feeding belt 21 and a belt drive portion 22.

Figure 2:
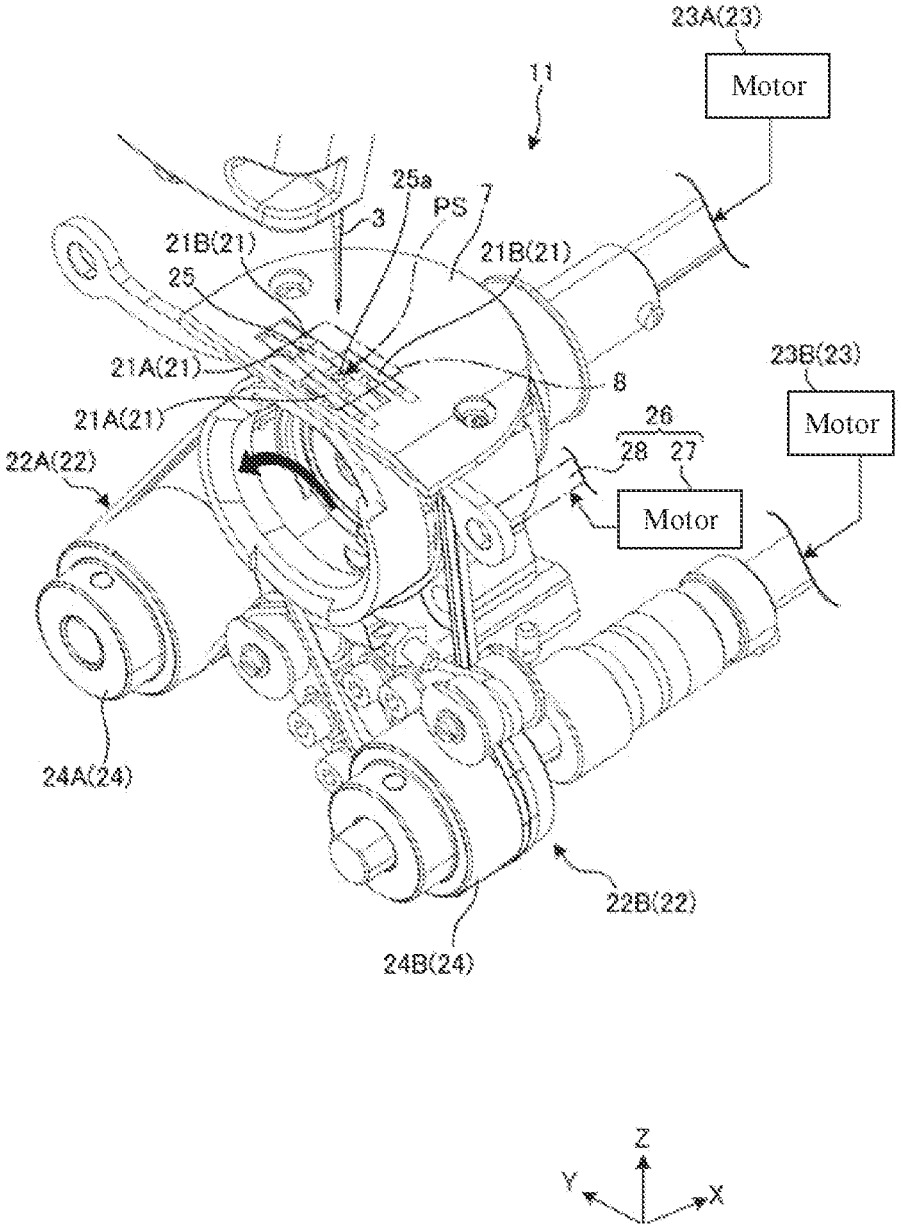
FIG. 2 is a diagram showing a feeding mechanism according to an embodiment.

FIG. 2 is a diagram showing a feeding mechanism according to an embodiment. As shown in FIG. 2, the feeding belt 21 is in contact with a back surface Sb of the to-be-sewn article S. The feeding belts 21 is endless. The feeding belt 21 is provided on two sides in the X-axis direction with respect to the sewing position PS. Two feeding belts 21 are provided on two sides in the X-axis direction with respect to the sewing position PS, and a total of four feeding belts 21 are provided. Hereinafter, the two feeding belts 21 provided on one side (−X side) in the X-axis direction with respect to the sewing position PS are denoted as feeding belts 21A, and the two feeding belts 21 provided on another side (+X side) in the X-axis direction with respect to the sewing position PS are denoted as feeding belts 21B.

The belt drive portion 22 independently drives the feeding belts 21A on the −X side with respect to the sewing position PS and the feeding belts 21B on the +X side with respect to the sewing position PS. The belt drive portion 22 includes a drive line 22A that drives the feeding belts 21A on the −X side of the sewing position PS, and a drive line 22B that drives the feeding belts 21B on the +X side of the sewing position PS. The drive line 22A includes a motor 23A and a pulley 24A. The drive line 22B includes a motor 23B and a pulley 24B.

When the motors 23A and 23B operate, the feeding belts 21A supported by the pulley 24A and the feeding belts 21B supported by the pulley 24B rotate in the Y-axis direction. The to-be-sewn article S is fed in the Y-axis direction by a rotation of the feeding belts 21A and the feeding belts 21B.

In addition, as shown in FIG. 2, the needle hole guide mechanism 12 includes a needle hole guide member 25 and a guide drive portion 26. The needle hole guide member 25 is rod shaped, and is provided directly below the sewing needle 3. The needle hole guide member 25 is provided along the Y-axis direction. In this embodiment, the needle hole guide member 25 is provided between the feeding belts 21A on the −X side with respect to the sewing position PS and the feeding belts 21B on the +X side with respect to the sewing position PS. The needle hole guide member 25 supports the back surface Sb of the to-be-sewn article S. The needle hole guide member 25 is provided with a needle hole 25*a* through which the sewing needle 3 penetrates in the Z-axis direction.

The guide drive portion 26 makes the needle hole guide member 25 to move in the Z-axis direction. The guide drive portion 26 includes a motor 27 as a drive source, and a transmission mechanism 28 that transmits a driving force from the motor 27. The guide drive portion 26 can make the needle hole guide member 25 to move in the Z-axis direction independently of other components, that is, to move individually in the Z-axis direction.

In an embodiment, the needle hole guide member 25 is movable between a raised position P1 and a lowered position P2, for example. The raised position P1 is a position where an upper surface 25*b* of the needle hole guide member 25 is flush with an upper surface 25*b* of the throat plate 7. The lowered position P2 is a position where the upper surface of the needle hole guide member 25 is provided below the upper surface of the throat plate 7. When the needle hole guide member 25 is provided in the lowered position P2 with the to-be-sewn article S provided in the sewing position PS, a gap is formed between the to-be-sewn article S and the upper surface of the needle hole guide member 25.

The control portion 30 centrally controls an operation of the sewing machine 1. The control portion 30 includes a processing portion 31 and a storage portion 32. The processing portion 31 performs various information processing. The processing portion 31 includes a processor such as a central processing unit (CPU), and a memory such as a read only memory (ROM) and a random access memory (RAM).

The processing portion 31 includes a lifting drive control portion 33, a determination portion 35, a belt drive control portion 34 and a guide drive control portion 36.

The lifting drive control portion 33 controls a movement of the sewing needle 3 in the Z-axis direction by controlling a rotation of the motor 10.

The determination portion 35 determines whether the sewing needle 3 pierces the to-be-sewn article S for a first time or for a second time or later. In an embodiment, the determination portion 35 can measure a rotation speed of the motor 10 and calculate a number of times that the sewing needle 3 pierces the to-be-sewn article S based on a measured value.

The belt drive control portion 34 controls a movement of the feeding belts 21A and the feeding belts 21B in the Y-axis direction by controlling a rotation of the motor 23A and a rotation of the motor 23B of the belt drive portion 22.

The guide drive control portion 36 controls a movement of the needle hole guide member 25 in the Z-axis direction by controlling the rotation of the motor 27 of the guide drive portion 26. The guide drive control portion 36 controls the guide drive portion 26 so that the needle hole guide member 25 moves in the Z-axis direction independently of a reciprocating movement of the sewing needle 3.

The guide drive control portion 36 controls the guide drive portion 26 during a sewing operation so that the needle hole guide member 25 is located at the raised position P1 when the sewing needle 3 pierces the to-be-sewn article S for a first time.

The guide drive control portion 36 controls the guide drive portion 26 during the sewing operation so that the needle hole guide member 25 is located at the lowered position P2 when the sewing needle 3 pierces the to-be-sewn article S for the second time or later.

The guide drive control portion 36 controls the guide drive portion 26 during the sewing operation so that the needle hole guide member 25 is located at the raised position P1 when the sewing needle 3 pierces the to-be-sewn article S for the second time or later. When the sewing needle 3 is pulled out from the to-be-sewn article S, the needle hole guide member 25 is located at the lowered position P2.

The storage portion 32 stores information such as various programs and data. The storage portion 32 includes storage apparatuses such as a hard disk drive (HDD) and a solid state drive (SSD).

In the control portion 30, the processor reads out various programs in the processing portion 31 and unrolls the various programs into the memory, and executes information processing corresponding to functions of the above-mentioned portions. Examples of various programs include programs stored in the storage portion 32, programs stored in an external storage medium, and the like. The control portion 30 functions as an information processing apparatus (computer) that performs various information processing. Furthermore, various programs may be executed by other information processing apparatuses different from the control portion 13, or various programs may be executed by the control portion 30 in cooperation with other information processing apparatuses.

The operation of the sewing machine 1 configured as above is described in the following. An operator arranges the to-be-sewn article S at the sewing position PS and makes the to-be-sewn article S to be a state of being pressed by the presser foot member 8. In this state, when the operator starts the sewing operation, the lifting drive control portion 33 of the control portion 30 controls the rotation of the motor 10 so that the sewing needle 3 moves back and forth in the Z-axis direction. In addition, the belt drive control portion 34 control a feeding capacity of the feeding belts 21A and the feeding belts 21B by controlling the rotation of the motor 23A and the motor 23B of the belt drive portion 22. In addition, the guide drive control portion 36 controls the movement of the needle hole guide member 25 in the Z-axis direction by controlling the rotation of the motor 27 of the guide drive portion 26.

In an embodiment, the operator can operate an operation panel (not shown) provided on the sewing machine 1, for example, and can set a mode for feeding the to-be-sewn article S to a belt feeding mode or a needle feeding mode. In addition, the operator can appropriately switch settings through the operation panel. In the control portion 30, the determination portion 35 determines whether the sewing needle 3 pierces the to-be-sewn article S for the first time or the second time or later.

Figure 3:
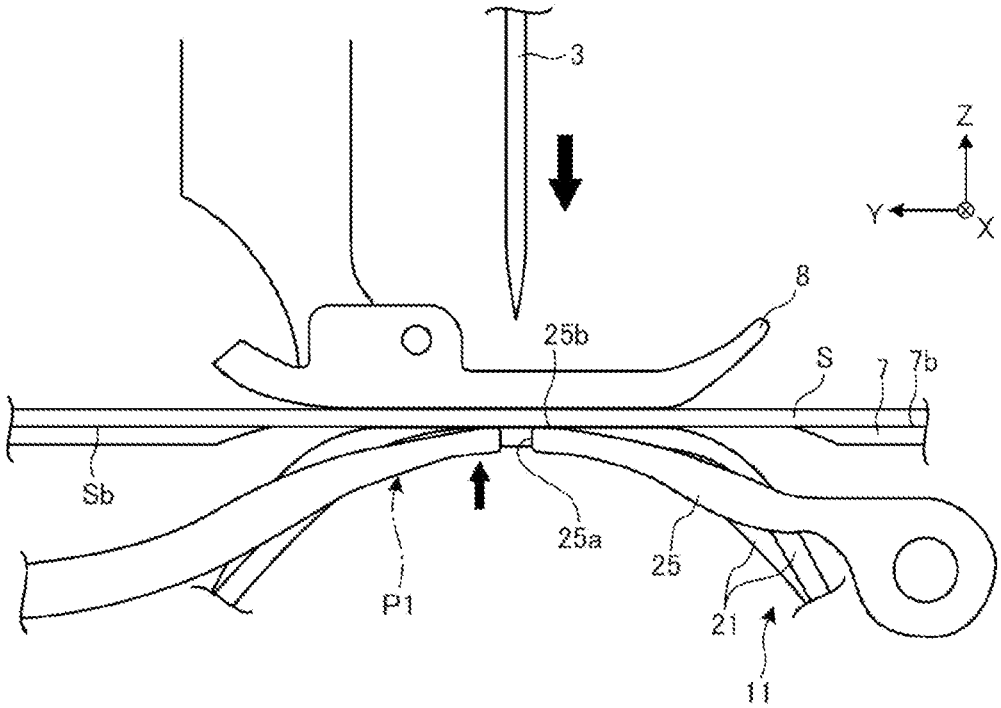
FIG. 3 is a diagram showing an operation when a sewing needle pierces a to-be-sewn article for a first time according to an embodiment.

FIG. 3 is a diagram showing an operation when a sewing needle pierces a to-be-sewn article for a first time according to an embodiment. When the determination portion 35 determines that the sewing needle 3 pierces the to-be-sewn article S for the first time, as shown in FIG. 3, the guide drive control portion 36 controls the guide drive portion 26 so that the needle hole guide member 25 is located at the raised position P1, by which the needle hole guide member 25 supports the back surface Sb of the to-be-sewn article S in a state where the upper surface 25*b* of the needle hole guide member 25 is flush with the upper surface 7*b* of the throat plate 7 at the raised position P1. In this case, a sewing defect such as a skipped stitch in a first piercing can be suppressed since threads can be stably connected.

Figure 4:
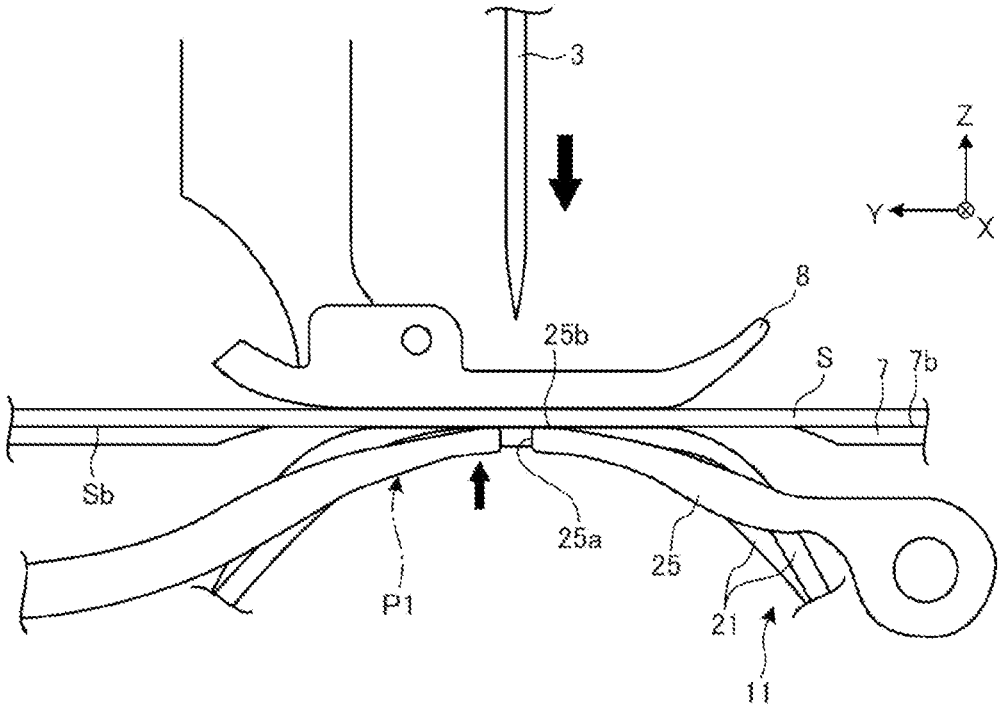
FIG. 4 is a diagram showing an operation when a sewing needle pierces a to-be-sewn article for a second time or later according to an embodiment.

FIG. 4 is a diagram showing an operation when a sewing needle pierces a to-be-sewn article for a second time or later according to an embodiment. When the determination portion 35 determines that the sewing needle 3 pierces the to-be-sewn article S for the second time or later, the guide drive control portion 36 controls the guide drive portion 26 so that the needle hole guide member 25 is located at the lowered position P2, by which the needle hole guide member 25 is configured so that a gap T is formed between the needle hole guide member 25 and the to-be-sewn article S in the lowered position P2. Since the gap T is formed between the to-be-sewn article S and the needle hole guide member 25, a resistance to the thread when the sewing needle 3 pierced into the to-be-sewn article S is pulled out can be reduced, and stitch tightness can be improved. Therefore, there is no need to increase tension to the thread when the sewing needle 3 is pulled out, and a thread breakage can be suppressed.

Figure 5:
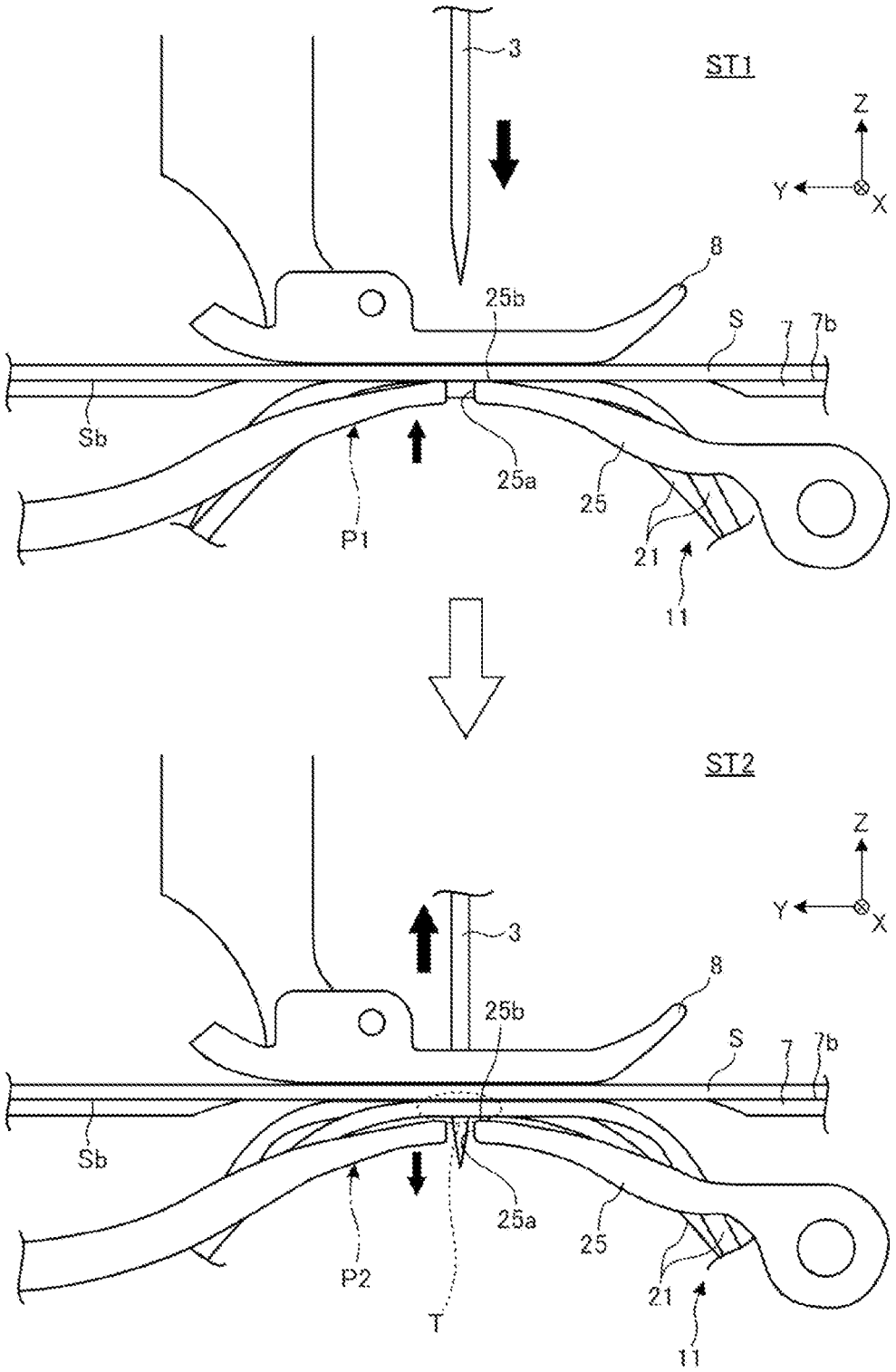
FIG. 5 is a diagram showing an operation when a sewing needle pierces a to-be-sewn article S for a second time or later according to another embodiment.

FIG. 5 is a diagram showing an operation when a sewing needle pierces a to-be-sewn article S for a second time or later according to another embodiment. When the determination portion 35 determines that the sewing needle 3 pierces the to-be-sewn article S for the second time or later, in an embodiment, the guide drive control portion 36 controls the guide drive portion 26 so that the needle hole guide member 25 is located in the raised position P1 when the sewing needle 3 pierces the to-be-sewn article S. and the needle hole guide member 25 is located in the lowered position P2 when the sewing needle 3 is pulled out from the to-be-sewn article S, by which the following state (ST1) is achieved. That is, when the sewing needle 3 pierces the to-be-sewn article S, the needle hole 25*a* is in contact with the back surface Sb of the to-be-sewn article S. Therefore, the sewing defect such as skipped stitch can be suppressed. In addition, when the sewing needle 3 is pulled out from the to-be-sewn article S, the needle hole guide member 25 is located at the lowered position P2, and a state (ST2) that the gap Tis formed between the needle hole guide member 25 and the to-be-sewn article S is achieved. Therefore, the resistance to the thread when the sewing needle 3 pierced into the to-be-sewn article S is pulled out can be reduced, the stitch tightness can be improved, and sewing defects such as skipped stitch can be suppressed.

As described above, the sewing machine 1 of this embodiment includes: the sewing needle 3, held by the needle bar 4 and moving back and forth while holding the upper thread; the shuttle 9, where the shuttle is configured to hold the bobbin around which the lower thread is wound and which is housed in the bobbin case, and the shuttle cooperates with the sewing needle 3 to form a seam SE; the presser foot member 8, configured to press the to-be-sewn article S at the sewing position PS directly below the sewing needle 3; the feeding mechanism 11, feeding the to-be-sewn article S from the sewing position PS to the Y-axis direction: the needle hole guide mechanism 12, including: the needle hole guide member 25, provided directly below the sewing needle 3, supporting the lower surface of the to-be-sewn article S and including the needle hole 25*a* through which the sewing needle 3 passes in the Z-axis direction, and movable in the Z-axis direction: and a guide drive portion 26, driving the needle hole guide member 25 to move individually in the Z-axis direction: the throat plate 7, provided around the needle hole guide member 25, and supporting the lower surface of the to-be-sewn article S: and the control portion 30, configured to control the guide drive portion 26 to make the needle hole guide member 25 moves in the Z-axis direction independently of the reciprocating movement of the sewing needle 3.

Based on this structure, since the needle hole guide member 25 provided directly below the sewing needle 3 and including the needle hole 25*a* moves in the Z-axis direction independently of the reciprocating movement of the sewing needle 3, a thread tension is not changed when the sewing needle 3 moves back and forth, and sewing defects can be suppressed.

In the sewing machine 1 of the embodiment, when the sewing needle 3 pierces into the to-be-sewn article S for the first time, the control portion 30 controls the guide drive portion 26 so that the needle hole guide member 25 is located at the raised position P1 where the throat plate 7 is flush with the upper surfaces (25*b*, 7*b*). Based on this structure, the needle hole guide member 25 supports the back surface Sb of the to-be-sewn article S at the raised position P1. Since the threads can be stably connected, the sewing defect called the skipped stitch in the first piercing can be suppressed.

In the sewing machine 1 of the embodiment, the control portion 30 controls the guide drive portion 26 so that when the sewing needle 3 pierces the to-be-sewn article S after the second time, the needle hole guide member 25 is located at the lowered position P2 below the upper surface 7*b* of the throat plate 7. Based on this structure, since there is the gap between the to-be-sewn article S and the needle hole guide member 25, the resistance to the thread when the sewing needle 3 is pulled out from the to-be-sewn article S can be reduced, and the stitch tightness is improved. Therefore, there is no need to increase tension to the thread when the sewing needle 3 is pulled out, and the thread breakage can be suppressed.

In the sewing machine 1 of the embodiment, the control portion 30 controls the guide drive portion 26 so that when the sewing needle 3 pierces the to-be-sewn article S after the second time, the needle hole guide member 25 is located at the raised position P1 where the throat plate 7 is flush with the upper surfaces (25*b* and 7*b*), and when the sewing needle 3 is pulled out of the to-be-sewn article S, the needle hole guide member 25 is located at the lowered position P2 below the upper surface 7*b* of the throat plate 7. Based on this structure, when the sewing needle 3 pierces the to-be-sewn article S, the state that the needle hole 25*a* is in contact with the back surface Sb of the to-be-sewn article S is achieved. Therefore, the sewing defect called skipped stitch can be suppressed. In addition, when the sewing needle 3 is pulled out from the to-be-sewn article S, the needle hole 25*a* is retracted downward, and the resistance of the thread when the sewing needle 3 is pulled out from the to-be-sewn article 3 can be reduced. Therefore, the stitch tightness is improved and sewing defects such as the skipped stitch can be suppressed.

In the sewing machine 1 of the embodiment, the feeding mechanism 11 includes: the endless feeding belts 21, which are provided on two sides in the X-axis direction orthogonal to the Y-axis direction with respect to the sewing position PS; and the belt drive portion 22, which independently drives the feeding belts 21A on the −X side of the X-axis direction with respect to the sewing position PS and the feeding belts 21B on the +X side of the X-axis direction with respect to the sewing position PS. Based on this structure, by a synchronized rotation or a differential movement of the feeding belts 21 on the −X side and the +X side with respect to the sewing position PS, the to-be-sewn article S can be fed in various ways.

The technical scope of the present disclosure is not limited to the above-described embodiments, and can be appropriately modified within the scope that does not deviate from the essence of the present disclosure. For example, in the above embodiments, the feeding mechanism 11 is provided with the endless feeding belts 21 and the belt drive portion 22, and the feeding mechanism 11 is not limited to this structure. For example, the feeding mechanism may also be provided with feeding teeth with a needle hole which allows the sewing needle 3 to pass through.

What is claimed is:

1. A sewing machine, comprising:

a sewing needle, held by a needle bar, and moving back and forth while holding an upper thread;

a shuttle, configured to hold a bobbin around which a lower thread is wound and which is housed in a bobbin case, and cooperating with the sewing needle to form a seam;

a presser foot member, configured to press a to-be-sewn article at a sewing position directly below the sewing needle;

a feeding mechanism, feeding the to-be-sewn article from the sewing position to a first direction;

a needle hole guide mechanism, comprising:

a needle hole guide member, provided directly below the sewing needle, supporting a lower surface of the to-be-sewn article, and comprising a needle hole through which the sewing needle passes in a vertical direction, and being movable in the vertical direction; and a guide drive portion, driving the needle hole guide member to move independently in the vertical direction; and a control portion, configured to control the guide drive portion to make the needle hole guide member move up and down independently of a reciprocating movement of the sewing needle;

wherein the sewing machine further comprises:

a throat plate, provided around the needle hole guide member, and supporting the lower surface of the to-be-sewn article, wherein the control portion controls the guide drive portion so that when the sewing needle pierces the to-be-sewn article for a first time, the needle hole guide member is located at a raised position where an upper surface of the needle hole guide member is flush with an upper surface of the throat plate.

2. The sewing machine of claim 1, wherein the control portion controls the guide drive portion so that when the sewing needle pierces the to-be-sewn article for a second time or later, the needle hole guide member is located at a lowered position where the needle hole guide member is below the upper surface of the throat plate.

3. The sewing machine of claim 1, wherein the control portion controls the guide drive portion so that when the sewing needle pierces the to-be-sewn article for a second time or later, the needle hole guide member is located at the raised position where the upper surface of the needle hole guide member is flush with the upper surface of the throat plate, and when the sewing needle is pulled out from the to-be-sewn article, the needle hole guide member is located at a lowered position where the needle hole guide member is below the upper surface of the throat plate.

4. The sewing machine of claim 1, wherein the feeding mechanism comprises:

feeding belts, provided on two sides in a second direction orthogonal to the first direction with respect to the sewing position; and a belt drive portion, independently driving the feeding belts on one side of the second direction with respect to the sewing position and the feeding belts on another side of the second direction with respect to the sewing position.

* * * * *